US012607036B2

(12) United States Patent
Svoboda et al.

(10) Patent No.: US 12,607,036 B2
(45) Date of Patent: Apr. 21, 2026

(54) EDGE PROTECTION BARRIER SEPARATE HANDRAIL

(71) Applicant: Honeywell Safety Products USA, Inc., Charlotte, NC (US)

(72) Inventors: Radim Svoboda, Brno (CZ); Jozef Macisak, Brno (CZ); Luca Favarin, Brno (CZ); Daniel Hannersjo, Ostersund (CZ)

(73) Assignee: Honeywell Safety Products USA, Inc., Latham, NY (US)

( * ) Notice: Subject to any disclaimer, the term of this patent is extended or adjusted under 35 U.S.C. 154(b) by 292 days.

(21) Appl. No.: 18/315,194

(22) Filed: May 10, 2023

(65) Prior Publication Data

US 2024/0376744 A1 Nov. 14, 2024

(51) Int. Cl.
*E04H 17/16* (2006.01)
*E04H 17/04* (2006.01)

(52) U.S. Cl.
CPC ..... *E04H 17/161* (2013.01); *E04H 17/05* (2021.01)

(58) Field of Classification Search
CPC ..... E04H 17/02; E04H 17/05; E04H 17/063; E04H 17/16; E04H 17/161; E04H 17/163; E04G 5/14; E04G 5/145; E04G 2005/148
USPC ..... 256/32, 33
See application file for complete search history.

(56) References Cited

U.S. PATENT DOCUMENTS 4,442,650 A * 4/1984 Sivachenko ..... E04C 3/09 52/840
4,558,851 A * 12/1985 Nakayama ..... E04H 17/161 256/73
4,718,642 A * 1/1988 Nakayama ..... E04H 17/161 256/73
5,542,649 A * 8/1996 Allegaert ..... E04H 17/161 256/54

(Continued)

FOREIGN PATENT DOCUMENTS

CH 683627 A5 4/1994
CN 104746820 A 7/2015

(Continued)

OTHER PUBLICATIONS

Radim Svoboda et al., U.S. Appl. No. 18/315,161 for "Barrier Handrail Reinforced Truss Beam", filed May 10, 2023.

(Continued)

*Primary Examiner* — Amber R Anderson
*Assistant Examiner* — Kevin J Baynes
(74) *Attorney, Agent, or Firm* — Fredrikson & Byron, P.A.

(57) ABSTRACT

A barrier that includes a plurality of first wires that extend in a horizontal direction is provided. The barrier can include a plurality of second wires that extend in a vertical direction. The barrier can include at least one third wire that extends in a direction orthogonal to the vertical direction. The plurality of second wires and one or more wires of the plurality of first wires can form a first portion extending in a first plane defined by the vertical direction and the horizontal direction. The at least one third wire and at least one wire of the plurality of first wires can form a second portion extending in a second plane defined by the horizontal direction and a transverse direction. The plurality of second (Continued)

wires can be excluded from the second portion. The at least one third wire can be excluded from the first portion.

19 Claims, 6 Drawing Sheets

(56) References Cited

U.S. PATENT DOCUMENTS

| | | | | | |
|---|---|---|---|---|---|
| 6,113,042 | A * | 9/2000 | Welsch | A47B 57/265 211/187 |
| 6,155,539 | A | 12/2000 | Nakayama | |
| 6,695,156 | B1 * | 2/2004 | Wang | A47B 57/265 108/147.11 |
| D597,342 | S * | 8/2009 | Dickson | D6/675.2 |
| D637,835 | S * | 5/2011 | Molayem | D6/675.3 |
| 8,272,624 | B1 * | 9/2012 | Frazier | E04H 17/063 256/32 |
| 8,613,130 | B2 * | 12/2013 | Larsen | E04H 17/161 29/430 |
| 9,091,096 | B2 * | 7/2015 | Cochrane | E04H 17/16 |
| 10,458,146 | B2 * | 10/2019 | Masserant | E01F 13/028 |
| D893,221 | S * | 8/2020 | Lim | D6/675.2 |
| 2008/0179577 | A1 * | 7/2008 | Neusch | E04H 17/16 256/1 |
| 2010/0295007 | A1 | 11/2010 | Preston | |
| 2011/0079761 | A1 * | 4/2011 | Young | E04H 17/161 256/24 |
| 2014/0318891 | A1 | 10/2014 | Crothers et al. | |
| 2021/0254354 | A1 | 8/2021 | Persson | |
| 2022/0259888 | A1 * | 8/2022 | Stucchi | E04H 17/161 |

FOREIGN PATENT DOCUMENTS

| | | | | | |
|---|---|---|---|---|---|
| CN | 207513320 | U | | 6/2018 | |
| EP | 0882857 | A1 | | 12/1998 | |
| EP | 1467045 | B1 | | 3/2008 | |
| EP | 3620592 | B1 | | 10/2020 | |
| GB | 1032475 | A | * | 6/1966 | E04H 17/161 |
| GB | 2167786 | A | * | 6/1986 | E04H 17/003 |
| GB | 2400398 | A | | 10/2004 | |
| GB | 2411685 | A | | 9/2005 | |
| GB | 2418701 | A | * | 4/2006 | E04G 21/3204 |
| JP | 06042234 | A | * | 2/1994 | E04H 17/16 |
| KR | 20140119414 | A | * | 10/2014 | E04H 17/08 |
| WO | 2012/023035 | A2 | | 2/2012 | |
| WO | WO-2012048843 | A1 | * | 4/2012 | E04H 7/161 |

OTHER PUBLICATIONS

Safesite Facilities, "Edge Protection," Product Specification Sheet, 4 pages, (Aug. 2021). [Retrieved from the Internet Sep. 1, 2023: URL: <https://www.safesitefacilities.co.uk/static/8182f3b3d3c4ec7a670dd4c65d692a11/Edge-Protection-Specification-Sheet-NEW.pdf>].

Extended European Search Report Mailed on Dec. 18, 2024 for EP Application No. 24172386, 8 page(s).

Extended European Search Report Mailed on Sep. 10, 2024 for EP Application No. 24170386, 7 page(s).

* cited by examiner

EDGE PROTECTION BARRIER SEPARATE HANDRAIL

TECHNICAL FIELD

The present application relates generally, in some examples, to a barrier. More specifically, the present application relates, in some examples, to an edge protection barrier.

BACKGROUND

Barriers, such as steel mesh barriers, are often installed on or near an edge of a structure, such as a building, to prevent debris or an individual from falling from the edge of the structure. The inventors have identified numerous deficiencies and problems with the existing technologies in this field. For example, existing technologies are either too heavy or do not achieve a desired minimum strength or durability. Through applied effort, ingenuity, and innovation, many of these identified deficiencies and problems have been solved by developing solutions that are structured in accordance with the embodiments of the present disclosure, many examples of which are described in detail herein.

BRIEF SUMMARY

In an example embodiment, a barrier is provided that defines a horizontal direction H, a vertical direction V that is orthogonal to the horizontal direction H, and a transverse direction T that is orthogonal to the horizontal direction H and the vertical direction V. The example barrier includes a plurality of first wires that extend in the horizontal direction H. The example barrier includes a plurality of second wires that extend in the vertical direction V. The example barrier includes at least one third wire that extends in a direction orthogonal to the vertical direction v. In an example embodiment, the plurality of second wires and one or more wires of the plurality of first wires form a first portion extending in a first plane defined by vertical direction V and horizontal direction H. In an example embodiment, the at least one third wire and at least one wire of the plurality of first wires form a second portion extending in a second plane defined by horizontal direction H and transverse direction T. In an example embodiment, the plurality of second wires do not extend into the second portion. In an example embodiment, the at least one third wire does not extend into the first portion.

In an example embodiment, the first portion is coupled to the second portion.

In an example embodiment, the first portion is coupled to the second portion by a wire of the plurality of first wires.

In an example embodiment, the first portion is coupled to the second portion by a metal bar.

In an example embodiment, the first portion is coupled to the second portion at a top end of the first portion.

In an example embodiment, the at least one third wire forms a zig-zag pattern along the horizontal direction H.

In an example embodiment, the at least one third wire comprises a single wire.

In an example embodiment, at least a portion of the at least one third wire extends at an angle between horizontal direction H and transverse direction T.

In an example embodiment, at least a portion of the at least one third wire extends in the horizontal direction H.

In an example embodiment, the second portion comprises a first end and a second end that is opposite the first end. In an example embodiment, the first end is coupled to the first portion. In an example embodiment, the second end is defined by a wire of the at least one wire of the plurality of first wires. In an example embodiment, the at least one third wire is coupled to the wire of the at least one wire of the plurality of first wires.

The barrier of an example embodiment further includes a bar. In an example embodiment, the bar comprises a vertical portion that extends in the vertical direction V and a transverse portion that extends in the transverse direction T. In an example embodiment, the vertical portion of the bar is parallel to the plurality of second wires. In an example embodiment, the transverse portion of the bar extends to the second end of the second portion. In an example embodiment, the bar is coupled to each of the plurality of first wires.

The barrier of an example embodiment further includes a third portion coupled to the first portion. In an example embodiment, the first portion is positioned in between the third portion and the second portion. In an example embodiment, the bar comprises a second transverse portion. In an example embodiment, the third portion of the barrier comprises the second transverse portion of the bar.

The barrier of an example embodiment further includes a sheet extending in the vertical direction V and the horizontal direction H, where the sheet is coupled to at least a subportion of each of the plurality of second wires.

In an example embodiment, an edge protection barrier configured to be coupled proximate to an edge of a building is provided that defines a horizontal direction H, a vertical direction V that is orthogonal to the horizontal direction H, and a transverse direction T that is orthogonal to the horizontal direction H and the vertical direction V. The example edge protection barrier includes a plurality of first wires that extend in the horizontal direction H. The example edge protection barrier includes a plurality of second wires that extend in the vertical direction V. The example edge protection barrier includes at least one third wire that extends in a direction orthogonal to the vertical direction v. In an example embodiment, the plurality of second wires and one or more wires of the plurality of first wires form a first portion extending in a first plane defined by vertical direction V and horizontal direction H. In an example embodiment, the at least one third wire and at least one wire of the plurality of first wires form a second portion extending in a second plane defined by horizontal direction H and transverse direction T. In an example embodiment, the plurality of second wires do not extend into the second portion. In an example embodiment, the at least one third wire does not extend into the first portion.

In an example embodiment, the first portion is coupled to the second portion.

In an example embodiment, the first portion is coupled to the second portion by a wire of the plurality of first wires.

In an example embodiment, the first portion is coupled to the second portion by a metal bar.

In an example embodiment, the first portion is coupled to the second portion at a top end of the first portion.

In an example embodiment, the at least one third wire forms a zig-zag pattern along the horizontal direction H.

In an example embodiment, the at least one third wire comprises a single wire.

In an example embodiment, at least a portion of the at least one third wire extends at an angle between horizontal direction H and transverse direction T.

In an example embodiment, at least a portion of the at least one third wire extends in the horizontal direction H.

In an example embodiment, the second portion comprises a first end and a second end that is opposite the first end. In an example embodiment, the first end is coupled to the first portion. In an example embodiment, the second end is defined by a wire of the at least one wire of the plurality of first wires. In an example embodiment, the at least one third wire is coupled to the wire of the at least one wire of the plurality of first wires.

The edge protection barrier of an example embodiment further includes a bar. In an example embodiment, the bar comprises a vertical portion that extends in the vertical direction V and a transverse portion that extends in the transverse direction T. In an example embodiment, the vertical portion of the bar is parallel to the plurality of second wires. In an example embodiment, the transverse portion of the bar extends to the second end of the second portion. In an example embodiment, the bar is coupled to each of the plurality of first wires.

The edge protection barrier of an example embodiment further includes a third portion coupled to the first portion. In an example embodiment, the first portion is positioned in between the third portion and the second portion. In an example embodiment, the bar comprises a second transverse portion. In an example embodiment, the third portion of the barrier comprises the second transverse portion of the bar.

The edge protection barrier of an example embodiment further includes a sheet extending in the vertical direction V and the horizontal direction H, where the sheet is coupled to at least a sub-portion of each of the plurality of second wires.

BRIEF DESCRIPTION OF THE DRAWINGS

Figure 1:
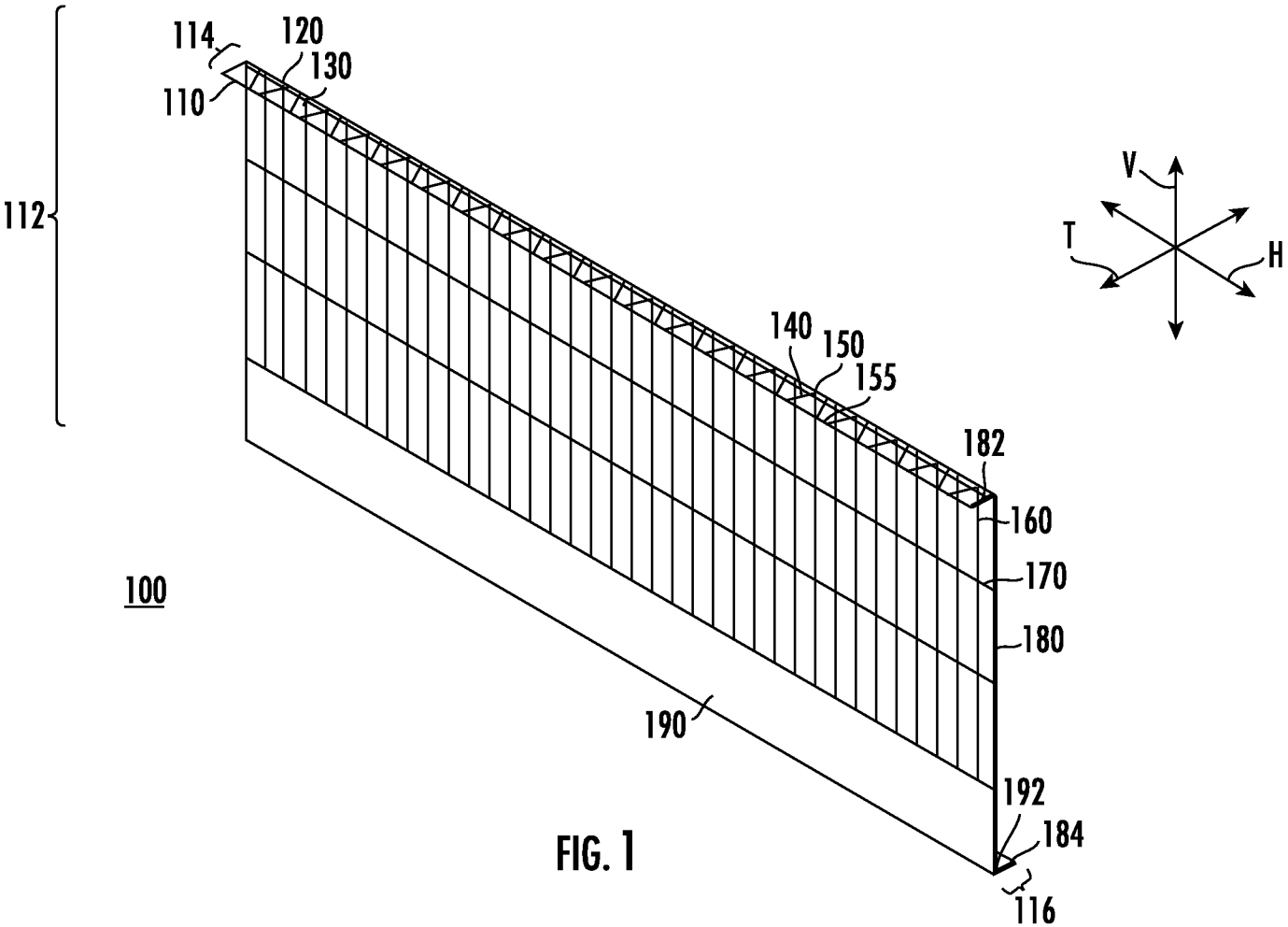

Having thus described certain example embodiments of the present disclosure in general terms above, non-limiting and non-exhaustive embodiments of the subject disclosure are described with reference to the following figures, which are not necessarily drawn to scale and wherein like reference numerals refer to like parts throughout the various views unless otherwise specified. The components illustrated in the figures may or may not be present in certain embodiments described herein. Some embodiments may include fewer (or more) components than those shown in the figures.

FIG. 1 provides a perspective view of a barrier, in accordance with an example embodiment.

Figure 2:
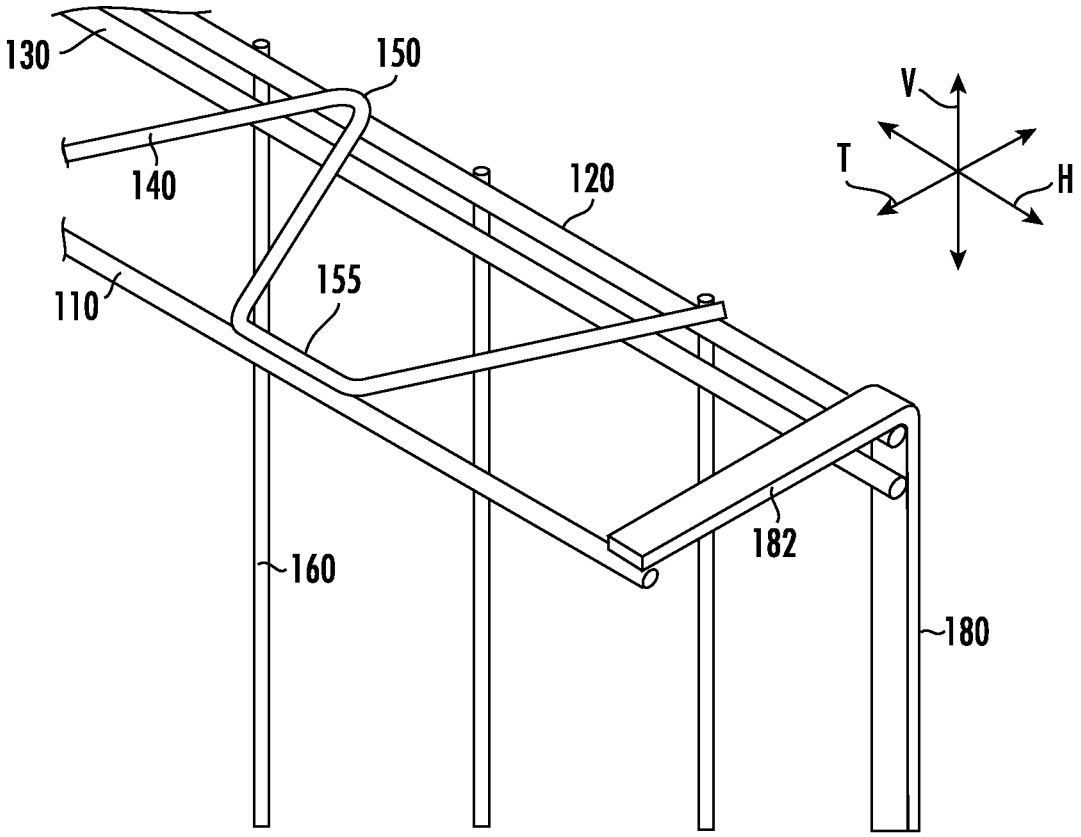

FIG. 2 provides a perspective view of a portion of the barrier of FIG. 1, in accordance with an example embodiment.

Figure 3:
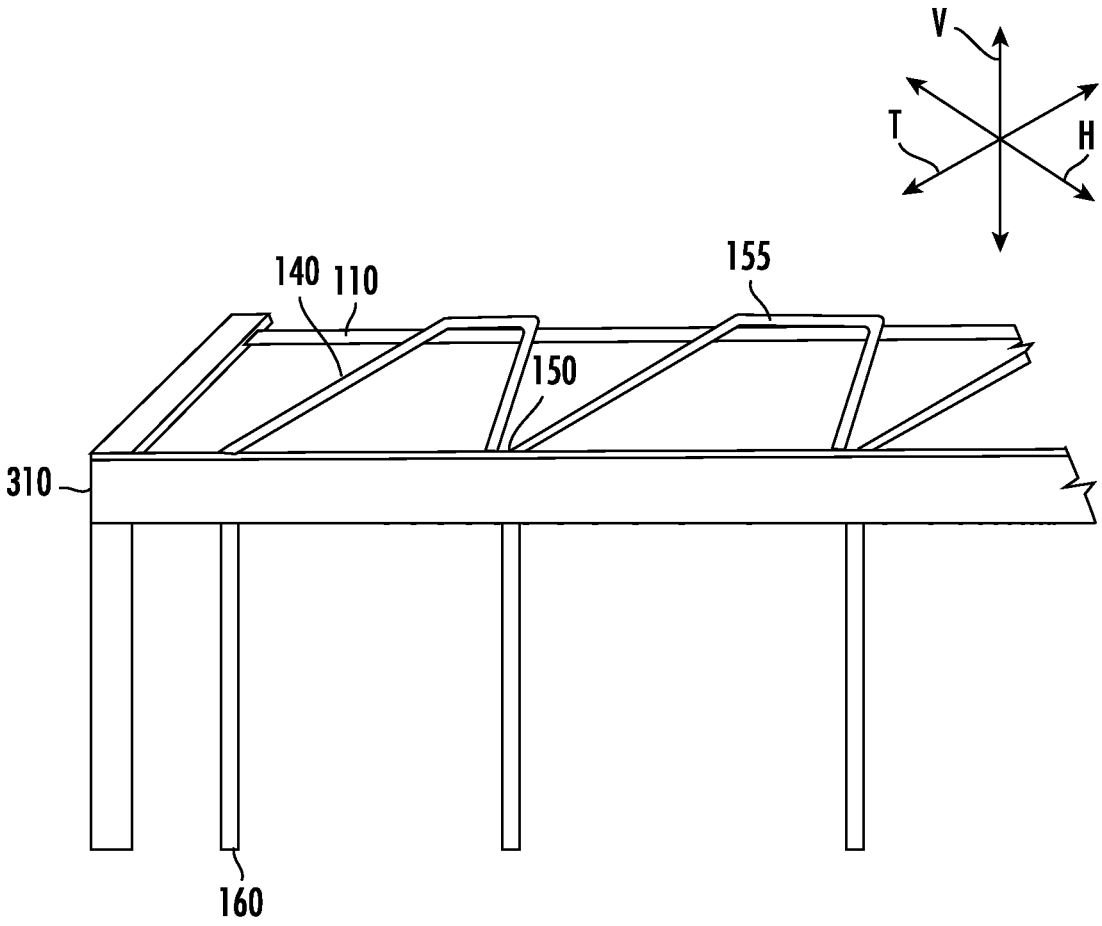

FIG. 3 provides a perspective view of a portion of the barrier of FIG. 1, in accordance with an alternative example embodiment.

Figure 4:
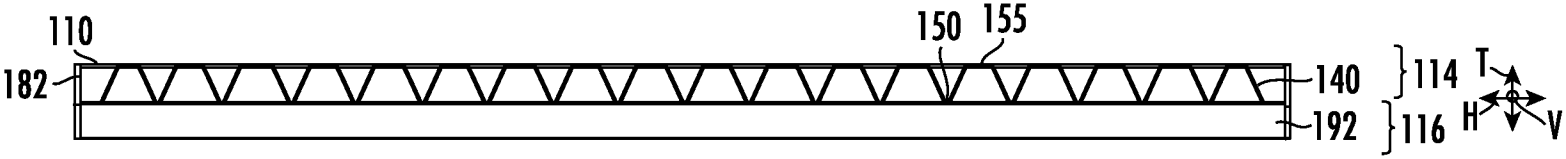

FIG. 4 provides a bottom view of the barrier of FIG. 1, in accordance with an example embodiment.

Figure 5:
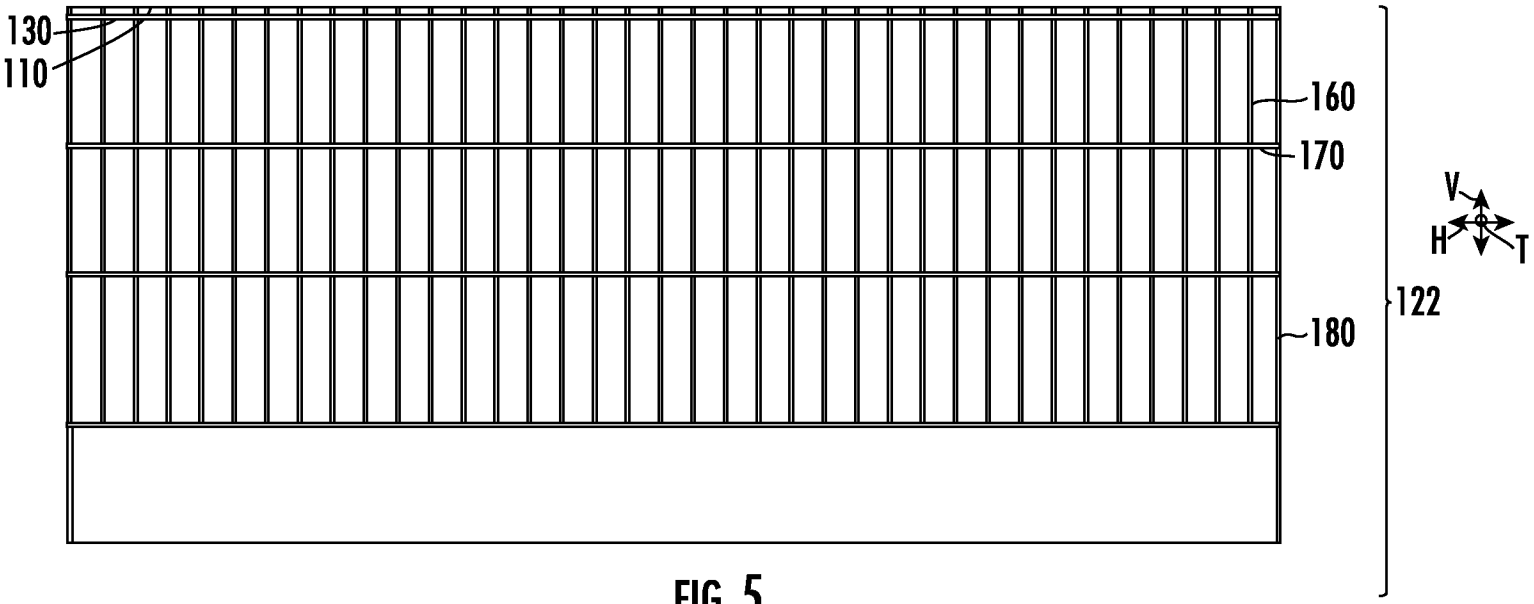

FIG. 5 provides a front view of the barrier of FIG. 1, in accordance with an example embodiment.

Figure 6:
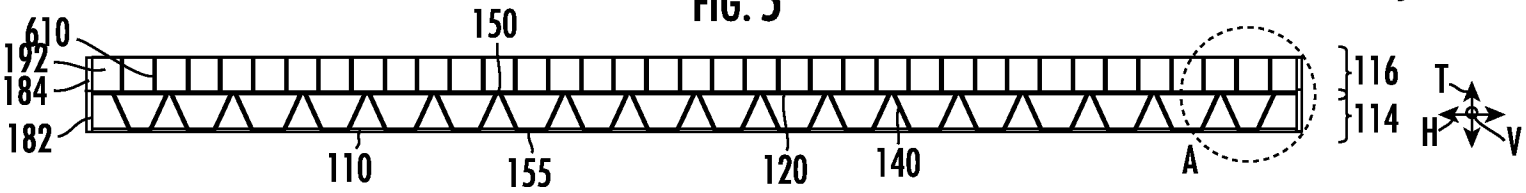

FIG. 6 provides a top view of the barrier of FIG. 1, in accordance with an example embodiment.

Figure 7:
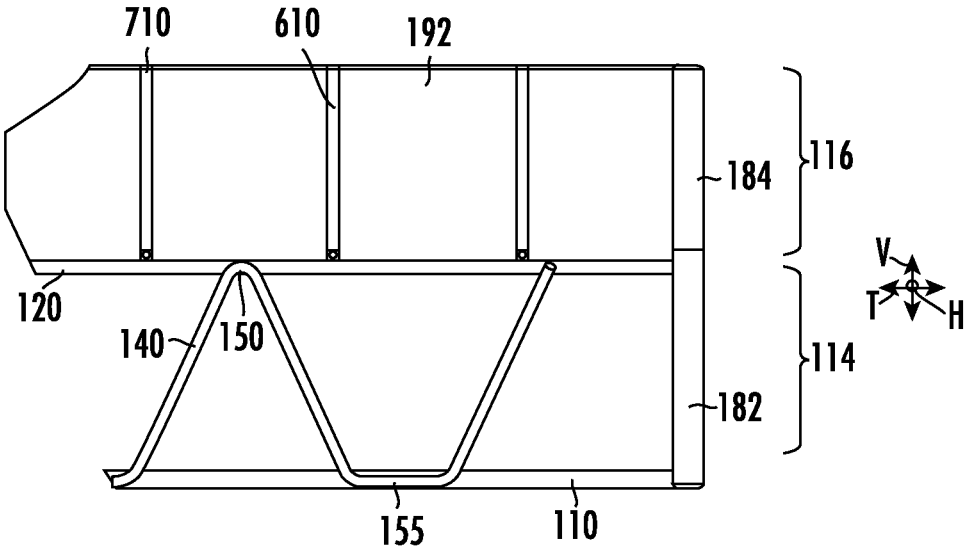

FIG. 7 provides a top view of a portion of the barrier of FIG. 1, in accordance with an example embodiment.

Figure 8:
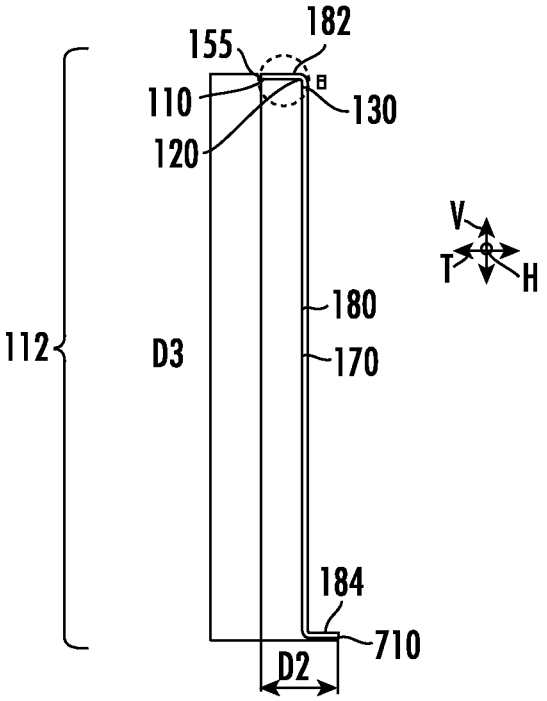

FIG. 8 provides a side view of the barrier of FIG. 1, in accordance with an example embodiment.

Figure 9:
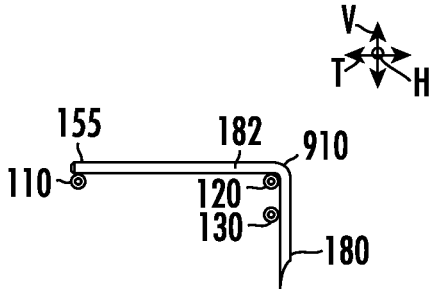

FIG. 9 provides a side view of a portion of the barrier of FIG. 1, in accordance with an example embodiment.

Figure 10:
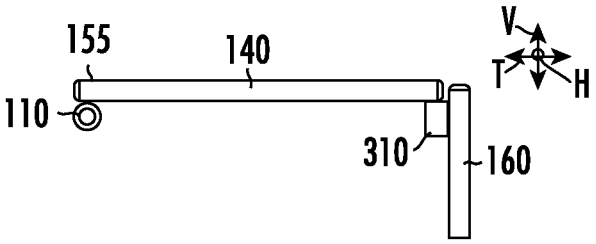

FIG. 10 provides a side view of a portion of the barrier of FIG. 1, in accordance with an alternative example embodiment.

DETAILED DESCRIPTION

One or more embodiments are now fully described with reference to the accompanying drawings, wherein like reference numerals are used to refer to like elements throughout and in which some, but not all embodiments of the inventions are shown. In the following description, for purposes of explanation, numerous specific details are set forth in order to provide a thorough understanding of the various embodiments. It is evident, however, that the various embodiments can be practiced without these specific details. It should be understood that some, but not all embodiments are shown and described herein. Indeed, the embodiments may be embodied in many different forms, and accordingly this disclosure should not be construed as limited to the embodiments set forth herein. Rather, these embodiments are provided so that this disclosure will satisfy applicable legal requirements.

As used herein, the term "exemplary" means serving as an example, instance, or illustration. Any aspect or design described herein as "exemplary" is not necessarily to be construed as preferred or advantageous over other aspects or designs. Rather, use of the word exemplary is intended to present concepts in a concrete fashion. In addition, while a particular feature may be disclosed with respect to only one of several implementations, such feature may be combined with one or more other features of the other implementations as may be desired and advantageous for any given or particular application. Furthermore, to the extent that the terms "includes" and "including" and variants thereof are used in either the detailed description or the claims, these terms are intended to be inclusive in a manner similar to the term "comprising."

As used herein, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As used herein, the terms "coupled," "fixed," "attached to," and the like refer to both direct coupling, fixing, or attaching, as well as indirect coupling, fixing, or attaching through one or more intermediate components or features, unless otherwise specified herein. As used herein, coupling can be accomplished through welding one component to another component.

As used herein, the term "positioned directly on" refers to a first component being positioned on a second component such that they make contact. Similarly, as used herein, the term "positioned directly between" refers to a first component being positioned between a second component and a third component such that the first component makes contact with both the second component and the third component. In contrast, a first component that is "positioned between" a second component and a third component may or may not have contact with the second component and the third component. Additionally, a first component that is "positioned between" a second component and a third component is positioned such that there may be other intervening components between the second component and the third component other than the first component.

It is desirable, in some examples, for barriers to be as light as possible while achieving a minimum strength. Embodiments of the present disclosure include, but are not limited to, a barrier that, in some examples, is lighter than traditional barriers while achieving a desired minimum strength or durability.

Referring now to FIG. 1, a perspective view of a barrier 100 is provided in accordance with an example embodiment. In one or more example embodiments, barrier 100 defines a horizontal direction H, a vertical direction V that is orthogonal to the horizontal direction H, and a transverse direction T that is orthogonal to the horizontal direction H and the vertical direction V. In one or more embodiments, the barrier defines a first portion 112 and a second portion 114. In some embodiments, the barrier 100 includes a third portion 116.

In some embodiments, the first portion 112 extends generally along a first plane defined by the horizontal direction H and the vertical direction V. In some embodiments, the second portion 114 extends generally along a second plane defined by the horizontal direction T (e.g., within sixty degrees, such as within forty-five degrees, such as within thirty degrees, such as within fifteen degrees, such as within ten degrees, such as within five degrees, such as within two degrees of the plane defined by the horizontal direction H and the transverse direction T). In some embodiments, the third portion 116, when included, extends generally along a plane defined by the horizontal direction H and the transverse direction T (e.g., within sixty degrees, such as within forty-five degrees, such as within thirty degrees, such as within fifteen degrees, such as within ten degrees, such as within five degrees, such as within two degrees of the plane defined by the horizontal direction H and the transverse direction T).

In some embodiments, the first portion 112 is positioned in between the second portion 114 and the third portion 116. In some embodiments, the second portion 114 is configured as a separate handrail from the first portion. In some embodiments, the first portion 112 is configured as debris mesh or debris netting for the barrier 100. In some embodiments, the separate handrail 114 is coupled to (e.g., welded on) first portion 112.

In some embodiments, the third portion 116, when included, is configured as a toeboard for the barrier 100. In some embodiments, the third portion 116 is coupled to the first portion 112.

In one or more embodiments, barrier 100 includes a sheet 190. In one or more embodiments, the sheet 190 extends in the vertical direction V and the horizontal direction H. In one or more embodiments, the sheet 190 comprises a bottom portion that extends in the horizontal direction H and the transverse direction T.

In one or more embodiments, the barrier 100 is configured to be coupled at a location proximate to an edge of a structure, such as a building. In one or more embodiments, the barrier 100 is configured as an edge protection barrier 100 that, in some examples, prevents an individual and/or debris from falling from the edge of the structure. In one or more embodiments, multiple barriers 100 are coupled together to form an edge protection system.

Referring now to FIG. 2, a perspective view of a portion of the barrier 100 of FIG. 1, is provided, in accordance with an example embodiment. In one or more embodiments, the barrier 100 includes a plurality of first wires, (e.g., the wires represented by reference characters 110, 120, 130, and 170), a plurality of second wires 160 extending in the vertical direction V, and at least one third wire 140 extending in a direction orthogonal to vertical direction V.

In one or more embodiments, as illustrated in FIGS. 1-2, the at least one third wire 140 forms a zig-zag pattern along the horizontal direction H. In one or more embodiments, the pattern comprises a series of trapezoidal shapes formed by the at least one third wire 140. In one or more embodiments, the pattern comprises a series of triangular shapes formed by the at least one third wire 140. In one or more embodiments, the pattern comprises a series of rectangular shapes formed by the at least one third wire 140. In one or more embodiments, the pattern is formed from any combination of trapezoidal, triangular, and/or rectangular shapes. In other embodiments, a variety of other patterns may be used. In one or more embodiments, this pattern increases the strength of the handrail, allowing a smaller diameter of wire to be used. In one or more example embodiments, this results in a lighter weight handrail. In one or more embodiments, as illustrated in FIGS. 1-2, the at least one third wire 140 comprises a single wire. However, in other embodiments, the at least one third wire 140 comprises a plurality of wires. In one or more embodiments, the at least one third wire 140 is coupled to the first portion 112 at points of contact 150. In one or more embodiments, the diameter of each of the plurality of first wires, each of the plurality of second wires, and the each of the at least one third wire ranges between 3 mm and 10 mm.

In one or more embodiments, the point of contact 150 occurs at a top end of the first portion 112. In one or more embodiments, the point of contact 150 occurs at a first end of the second portion 114. In one or more embodiments, the at least one third wire 140 is additionally coupled at points of contact 155 to a second end of second portion 114 defined by first wire 110.

In one or more embodiments, at least a portion of the at least one third wire 140 extends at an angle between horizontal direction H and transverse direction T. In one or more embodiments, at least a portion of third wire 140 extends in the horizontal direction H. In one or more embodiments, third wire 140 extends in the horizontal direction at points of contact 150 or 155. In one or more embodiments, the at least one third wire 140 does not extend into the first portion 112 and none of the plurality of second wires 160 extend into the second portion 114. In one or more embodiments, each of the plurality of first wires, the plurality of second wires, and the plurality of third wires comprises a metal, such as aluminum or steel.

In one or more embodiment, the barrier 100 includes a bar. In one or more embodiments, the bar includes a vertical portion 180 that extends in the vertical direction V and a transverse portion 182 that extends in the transverse direction T. In one or more embodiments, the transverse portion 182 is extended at an angle from transverse direction T (e.g., at an angle within sixty degrees of transverse direction T, such as within forty-five degrees, such as within thirty degrees, such as within fifteen degrees, such as with ten degrees, such as within five degrees, such as within two degrees of transverse direction T). In one or more embodiments, the vertical portion of the bar 180 runs parallel to the plurality of second wires 160. In one or more embodiments, the transverse portion 182 of the bar extends the same transverse distance as between first end point of contact 150 and second end point of contact 155. In one or more embodiments, the transverse portion 182 of the bar extends from the first portion 112 to the end of the second portion 114 defined by first wire 110. In one or more embodiments, the vertical portion 180 of the bar to one or more of the plurality of first wires, e.g., wires 120, 130, and 170. In one or more embodiments, the bar comprising vertical portion 180 contains a metal such as aluminum or steel. In one or more embodiments, the bar is a rectangular shape. However, in other embodiments, the bar may be any one of a number of different shapes, such as a cylindrical shape. In some embodiments, a round wire is used at the end of the barrier 100.

Referring again to FIG. 1, in one or more embodiments, the plurality of second wires 160 and one or more wires of the plurality of first wires (e.g., the wires 120, 130, and 170) from the first portion 112 of the barrier 100, which can be configured as a debris mesh for the barrier. In one or more embodiments, the at least one third wire 140 and at least one wire of the plurality of first wires (e.g., wire 110) form the second portion 114 of barrier 100, which can be configured as a separate handrail for the barrier 100. In one or more embodiments, each of the plurality of second wires 160 extend generally parallel to each other along a full length of each of the plurality of second wires 160.

In one or more embodiments, the second portion 114 is configured separately from and coupled to the first portion 112. For example, second portion 114 and first portion 112 may be coupled at wire 120 of the plurality of first wires.

In one or more embodiments and in some examples, technical advantages are provided by configuring the second portion 114 as a separate handrail. In one or more embodiments, configuring second portion 114 as a second handrail saves material costs, in some examples, because wires do not need to extend over points of contact 150, such as over wire 120. In one or more embodiments, configuring the second portion 114 as a separate handrail allows, in some examples, a high level of strength and durability in barrier 100. In one or more embodiments, the diameter of wires used (e.g., the plurality of first wires 110, 120, 130, and 170, the plurality of second wires 160, the at least one third wire 140) may be narrowed, in some examples, to save further material costs.

Referring now to FIG. 3, a perspective view of a portion of the barrier 100 of FIG. 1, is provided, in accordance with an alternative example embodiment. As illustrated in FIG. 3, a second portion 114 may be coupled to a first portion 112 by a metal bar 310. In one or more embodiments, the plurality of second wires 160 and the at least one third wire 140 may be coupled to metal bar 310. In one or more embodiments, the metal bar 310 is coupled (e.g., welded) over the plurality of second wires 160 and the at least one third wire 140. In one or more alternative embodiments, the metal bar 310 is coupled (e.g., welded) under the plurality of second wires 160 and the at least one third wire 140. A side view of an arrangement where metal bar 310 is coupled under the plurality of second wires 160 and the at least one third wire 140 is provided in FIG. 10.

Referring now to FIG. 4, a bottom view of barrier 100 is provided, in accordance with an example embodiment. In one or more embodiments, the sheet 190 comprises a second section 192 configured as a toeboard for the barrier 100. In one or more embodiments, section 192 extends in a direction opposite to the transverse portion 182 of the bar. In one or more embodiments, the second section 192 extends in a direction such that the first portion 112 of barrier 100 is positioned in between the second section 192 and the second portion 114 of the barrier 100. In one or more embodiments, third portion 116 comprises second section 192.

Referring now to FIG. 5, a front view of barrier 100 is provided, in accordance with an example embodiment. In one or more embodiments, a distance D1 defines the length of the barrier extending in the horizontal direction H. In one or more embodiments, distance D1 is 2602 millimeters. In one or more embodiments, distance D1 may be greater or less than 2602 millimeters. For example, distance D1 may be less than 2602 millimeters, such as less than 2202 millimeters, such as less than 1802 millimeters, such as less than 1402 millimeters, such as less than 1002 millimeters. In one or more embodiments, distance D1 may be greater than 2602 millimeters, such as greater than 2002 millimeters, such as greater than 3402 millimeters, such as greater than 3802 millimeters, such as greater than 4202 millimeters. In one or more embodiments, the length D1 may be greater than the height of the barrier in the vertical direction H. In one or more embodiments, the length D1 may extend the length or width of a structure for which fall protection is desired. In one or more embodiments, a plurality of barriers 100 may be used, and a length or width of a structure for which fall protection is desired may be greater than distance D1. In one or more embodiments, the sheet 190 is coupled to at least a sub-portion of each of the plurality of second wires 160. In one or more embodiments, sheet 190 is configured as debris mesh for the barrier 100.

Referring now to FIG. 6, a top view of barrier 100 is provided, in accordance with an example embodiment. In one or more embodiments, each of the plurality of second wires 160 comprises a transverse portion 610 configured to extend into third portion 116 of barrier 100. In one or more embodiments, the transverse portions 610 are configured to extend in a direction opposite to the transverse direction T which second portion 114 extends on. In one or more embodiments, transverse portions 610 extend in a direction such that the first portion 112 (not shown in FIG. 6) of barrier 100 is positioned in between second portion 114 of barrier 100 and transverse portions 610. In one or more embodiments, the second section 192 is coupled (e.g., welded) to each of the transverse portions 610 of the plurality of second wires 160.

Referring now to FIG. 7, a close-up view of detail circle A of FIG. 6 is provided, in accordance with an example embodiment. In one or more embodiments, the at least one third wire 140 extends in a direction orthogonal to vertical direction V. In one or more embodiments, the at least one third wire 140 forms a zig-zag pattern along the horizontal direction H across the entire transverse area of second portion 114. In one or more embodiments, the at least one third wire 140 comprises a single wire. However, in other embodiments, the at least one third wire 140 comprises a plurality of wires. In one or more embodiments, the at least one third wire 140 is coupled to the first portion 112 at points of contact 150. In one or more embodiments, the point of contact 150 occurs at the first end of the second portion 114. In one or more embodiments, the at least one third wire 140 is additionally coupled at points of contact 155 to a second end of second portion 114 defined by first wire 110. In one or more embodiments, at least a portion of the at least one third wire 140 extends at an angle between horizontal direction H and transverse direction T. In one or more embodiments, at least a portion of third wire 140 extends in the horizontal direction H. In one or more embodiments, third wire 140 extends in the horizontal direction at points of contact 150 or 155. In one or more embodiments, third wire 140 may have at least one transverse portion extending directly along transverse direction T between a point of contact 150 and a point of contact 155. In one or more embodiments, the at least one third wire 140 may comprise a variety of other shapes and directions to across second portion 114. In one or more embodiments, the at least one third wire 140 does not extend into the first portion 112 and the plurality of second wires 160 do not extend into second portion 114. In one or more embodiments, this saves material costs and cases manufacturing by allowing a first portion 112 to be coupled (e.g., welded) to a second portion 114.

In one or more embodiments, the plurality of second wires 160 extend to an end 710 of the third portion 116 through transverse portion 610. In one or more embodiments, the plurality of second wires extend to the top of first portion 112. In one or more embodiments, the bar comprises a second transverse portion 184 coupled to the second section 192 of the sheet 190. In one or more embodiments, the second transverse portion 184 of the bar is configured to extend in parallel with the transverse portions 610 of the plurality of second wires 160. In one or more embodiments, the second transverse portion 184 is configured to extend in a direction opposite of transverse portion 182 of the same bar. In one or more embodiments, the second transverse portion 184 of the bar extends such that vertical portion 180 of the bar is positioned in between transverse portion 182 and second transverse portion 184 of the bar. In one or more embodiments, at least vertical portion 180 and transverse portion 182 of the bar is coupled to each of the plurality of first wires, e.g., wires 110 and 120.

Referring now to FIG. 8, a side view of the barrier 100 of FIG. 1 is provided, in accordance with an example embodiment. In various examples, at least one of the plurality of first wires (e.g., wires 110 and 120) are positioned directly on, or coupled to, the transverse portion 182 of the bar. In various examples, at least one of the plurality of first wires (e.g., wires 130 and 170) are positioned directly on, or coupled to, the vertical portion 180 of the bar. In one or more embodiments, barrier 100 includes more or less first wires than depicted in FIG. 8.

In various examples, and as depicted in FIG. 8, a distance D2 that extends in the transverse direction from end 710 to the second end of portion 114 provided by point of contact 155 and first wire 110 is provided. In one or more embodiments, distance D2 represents the transverse distance covered by barrier 100. In one or more embodiments, distance D2 is 158 millimeters. In one or more embodiments, D2 may be a distance greater than or less than 158 millimeters. In one or more embodiments, D2 may be less than 158 millimeters, such as less than 138 millimeters, such as less than 118 millimeters, such as less than 98 millimeters, such as less than 78 millimeters. In one or more embodiments, D2 may be greater than 158 millimeters, such as greater than 178 millimeters, such as greater than 198 millimeters, such as greater than 198 millimeters, such as greater than 218 millimeters, such as greater than 238 millimeters.

In various examples, and as depicted in FIG. 8, a distance D3 that extends in the vertical direction for the length of the plurality of second wires 160 and/or the vertical portion 180 of the bar. In one or more embodiments, distance D3 represents the vertical distance covered by the barrier 100. In one or more embodiments, distance D3 is 1149 millimeters. In one or more embodiments, D3 may be a distance greater than or less than 1149 millimeters. For example, D3 may be less than 1149 millimeters, such as less than 1049 millimeters, such as less than 949 millimeters, such as less than 849 millimeters, such as less than 749 millimeters. In one or more embodiments, D3 may be greater than 1149 millimeters, such as greater than 1249 millimeters, such as greater than 1349 millimeters, such as greater than 1449 millimeters, such as greater than 1549 millimeters.

In one or more embodiments, a ratio D1:D2 may be between 16:1 and 17:1. In one or more embodiments, a ratio D1:D2 may be less than 16:1, such as less than 12:1, such as less than 9:1, such as less than 6:1, such as 3:1.

In one or more embodiments, a ratio D1:D3 is between 2:1 and 3:1. i be less than 2:1, such as less than 1.5:1, or greater than 3:1, such as greater than 4:1.

In one or more embodiments, a ratio D3:D2 may be between 7:1 and 8:1. In one or more embodiments, a ratio D3:D2 may be less than 7:1, such as less than 6:1, or greater than 8:1, such as greater than 9:1.

It should be understood that the specific dimensions provided in relation to FIG. 8 are exemplary and that the barrier 100 can be sized larger or smaller for certain application. As such, the specific dimensions provided may increase or decrease as the barrier 100 is sized larger or smaller. Therefore, the distances D1, D2, and D3 can define ratios that may provide various benefits.

Referring now to FIG. 9, a closeup view of detail circle B of FIG. 8 is provided, in accordance with an example embodiment. In one or more embodiments, the plurality of first wires may be coupled with transverse portion 182 and/or vertical portion 180 of the bar. In one or more embodiments, first wire 110 of the plurality of first wires is coupled with the transverse portion 182 of the bar at the second end of second portion 114 (proximate to point of contact 155). In one or more embodiments, first wire 120 of the plurality of first wires is coupled to a curved portion 910 of the bar that connects transverse portion 182 and vertical portion 180. In one or more embodiments, first wire 130 of the plurality of first wires is coupled to the vertical portion 180 of the bar at a position proximate to the curved portion 810 and the transverse portion 182 of the bar.

In various examples, each of the plurality of first wires (e.g., wires represented by reference characters 110, 120, 130, and 170), each of the plurality of second wires 170, and the at least one third wire 140 are generally cylindrical shaped such that they have circular cross-sectional shapes. However, in various other examples, each of the plurality of first wires (e.g., wires represented by reference characters 110, 120, 130, and 170), each of the plurality of second wires 160, and the at least one third wire 140 have non-circular cross-sectional shapes. For example, each of the plurality of first wires (e.g., wires represented by reference characters 110, 120, 130, and 170), the plurality of second wires 160, and the at least one third wire 140 can have cross-sectional shapes that are triangle-shaped, quadrilateral-shaped, pentagon-shaped, hexagon-shaped, etc.

Referring now to FIG. 10, a side view of a portion of barrier 100 is provided, in accordance with an example embodiment. In this example embodiment, metal bar 210 is illustrated and the bar including vertical portion 180 and transverse portion 182 is not included, but in other example embodiments with metal bar 210 the bar comprising vertical portion 180 and transverse portion 182 may be present. In one or more embodiments, a side view is illustrated where the at least one third wire 140 and the plurality of second wires 160 are coupled to the top of the metal bar 210. In one or more example embodiments, using metal bar 210 to couple the handrail 114 to first portion 112 may be technically advantageous by increasing the strength and durability of the barrier. By increasing strength and durability of the barrier, a narrower diameter size may be used for the wires and bars disclosed herein, resulting in a lighter weight barrier. In one or more embodiments, metal bar 210 comprises aluminum or steel. In one or more embodiments, metal bar 210 has a rectangular shape. In one or more alternative embodiments, metal bar 210 may have a cross-sectional shape that s triangle-shaped, circle-shaped, pentagon-shaped, hexagon-shaped, etc.

CONCLUSION

The above descriptions of various embodiments of the subject disclosure and corresponding figures and what is described in the Abstract, are described herein for illustrative purposes, and are not intended to be exhaustive or to limit the disclosed embodiments to the precise forms disclosed. It is to be understood that one of ordinary skill in the art may recognize that other embodiments having modifications, permutations, combinations, and additions can be implemented for performing the same, similar, alternative, or substitute functions of the disclosed subject matter, and are therefore considered within the scope of this disclosure. Therefore, the disclosed subject matter should not be limited to any single embodiment described herein, but rather should be construed in breadth and scope in accordance with the appended claims below. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A barrier that defines a horizontal direction H, a vertical direction V that is orthogonal to the horizontal direction H, and a transverse direction T that is orthogonal to the horizontal direction H and the vertical direction V, wherein the barrier comprises:

a plurality of first wires that extend in the horizontal direction H;

a plurality of second wires that extend in the vertical direction V; and at least one third wire that extends at least partially in the horizontal direction H and in the transverse direction T, wherein the plurality of second wires and one or more wires of the plurality of first wires form a first portion extending in a first plane defined by vertical direction V and horizontal direction H, wherein the at least one third wire and at least one wire of the plurality of first wires form a second portion extending in a second plane defined by horizontal direction H and transverse direction T, wherein the plurality of second wires do not extend through the second plane of the second portion, and wherein the at least one third wire does not extend into the first portion.

2. The barrier of claim 1, wherein the first portion is coupled to the second portion.

3. The barrier of claim 2, wherein the first portion is coupled to the second portion by a wire of the plurality of first wires.

4. The barrier of claim 2, wherein the first portion is coupled to the second portion by a metal bar.

5. The barrier of claim 2, wherein the first portion is coupled to the second portion at a top end of the first portion.

6. The barrier of claim 1, wherein the at least one third wire forms a zig-zag pattern-along the horizontal direction H.

7. The barrier of claim 1, wherein the at least one third wire extends on a single plane.

8. The barrier of claim 1, wherein at least a portion of the at least one third wire extends at an angle between the horizontal direction H and the transverse direction T.

9. The barrier of claim 1, wherein the second portion comprises a first end and a second end that is opposite the first end, wherein the first end is coupled to the first portion, wherein the second end is defined by a wire of the at least one wire of the plurality of first wires, and wherein the at least one third wire is coupled to the wire of the at least one wire of the plurality of first wires.

10. The barrier of claim 9, further comprising a bar, wherein the bar comprises a vertical portion that extends in the vertical direction V and a transverse portion that extends in the transverse direction T, wherein the vertical portion of the bar is parallel to the plurality of second wires, wherein the transverse portion of the bar extends to the second end of the second portion, and wherein the bar is coupled to each of the plurality of first wires.

11. The barrier of claim 10, further comprising a third portion coupled to the first portion, wherein the first portion is positioned in between the third portion and the second portion, wherein the bar comprises a second transverse portion, and wherein the third portion of the barrier comprises the second transverse portion of the bar.

12. The barrier of claim 11, further comprising a sheet extending in the vertical direction V and the horizontal direction H, wherein the sheet is coupled to at least a sub-portion of each of the plurality of second wires.

13. An edge protection barrier configured to be coupled proximate to an edge of a building, the edge protection barrier defining a horizontal direction H, a vertical direction V that is orthogonal to the horizontal direction H, and a transverse direction T that is orthogonal to the horizontal direction H and the vertical direction V, wherein the edge protection barrier comprises:

a plurality of first wires that extend in the horizontal direction H;

a plurality of second wires that extend in the vertical direction V; and at least one third wire that extends at least partially in the horizontal direction H and in the transverse direction T, wherein the plurality of second wires and one or more wires of the plurality of first wires form a first portion extending in a first plane defined by vertical direction V and horizontal direction H, wherein the at least one third wire and at least one wire of the plurality of first wires form a second portion extending in a second plane defined by horizontal direction H and transverse direction T, wherein the first portion is coupled to the second portion, wherein the plurality of second wires do not extend through the second plane of the second portion, and wherein the at least one third wire does not extend into the first portion.

14. The edge protection barrier of claim 13, wherein the first portion is coupled to the second portion by a wire of the plurality of first wires.

15. The edge protection barrier of claim 13, wherein the first portion is coupled to the second portion by a metal bar.

16. The edge protection barrier of claim 13, wherein the first portion is coupled to the second portion at a top end of the first portion.

17. The edge protection barrier of claim 13, wherein the at least one third wire forms a zig-zag pattern along the horizontal direction H.

18. The edge protection barrier of claim 17, wherein at least a portion of the at least one third wire extends at an angle between the horizontal direction H and the transverse direction T.

19. The edge protection barrier of claim 13, wherein the at least one third wire extends on a single plane in the horizontal direction H.

* * * * *